US006758451B2

(12) United States Patent
Rivera et al.

(10) Patent No.: US 6,758,451 B2
(45) Date of Patent: Jul. 6, 2004

(54) FOLDING SPEAKER BRACKET

(75) Inventors: Dean M. Rivera, Chula Vista, CA (US); Tim L. Simpson, Rancho San Diego, CA (US)

(73) Assignee: KSC Industries, Inc., San Diego, CA (US)

( * ) Notice: Subject to any disclaimer, the term of this patent is extended or adjusted under 35 U.S.C. 154(b) by 0 days.

(21) Appl. No.: 10/078,287

(22) Filed: Feb. 15, 2002

(65) Prior Publication Data

US 2003/0155473 A1 Aug. 21, 2003

(51) Int. Cl.[7] ..... H04R 1/02; A47F 5/08

(52) U.S. Cl. ..... 248/231.9; 248/27.1; 248/289.31; 248/343; 181/150; 181/171; 381/386

(58) Field of Search ..... 248/27.1, 205.1, 248/231.9, 314, 324, 325, 342, 288.11, 289.11, 289.31, 291.1, 292.13, 343; 181/150, 171, 172; 16/277, 285, 304, 307, 308, 256; 381/386, 389, 390, 395

(56) References Cited

U.S. PATENT DOCUMENTS

| | | | | | |
|---|---|---|---|---|---|
| 401,978 | A | * | 4/1889 | Spruce et al. | 16/304 |
| 765,372 | A | * | 7/1904 | Bading | 16/285 |
| 1,602,729 | A | * | 10/1926 | Walters | 16/256 |
| 1,883,508 | A | * | 10/1932 | Bonday | 248/536 |
| 2,568,942 | A | * | 9/1951 | Bindel | 248/27.1 |
| 2,770,436 | A | * | 11/1956 | Linhardt | 248/57 |
| 2,772,062 | A | * | 11/1956 | Bowser | 248/27.1 |
| 3,388,420 | A | * | 6/1968 | Ballantyne | 16/225 |
| 3,633,250 | A | * | 1/1972 | Romney | 403/76 |
| 4,074,883 | A | | 2/1978 | Daly et al. | 248/286 |
| 4,151,971 | A | | 5/1979 | Daly et al. | 248/286 |
| 4,484,658 | A | | 11/1984 | Grote | 181/150 |
| 4,778,134 | A | | 10/1988 | Struthers et al. | 248/27.1 |
| 4,928,312 | A | | 5/1990 | Hill | 381/192 |
| 5,143,339 | A | | 9/1992 | Ashcraft et al. | 248/343 |
| 5,221,069 | A | | 6/1993 | Struthers et al. | 248/231.9 |
| 5,574,796 | A | | 11/1996 | Keezer | 381/188 |
| 5,669,593 | A | * | 9/1997 | Kirchner | 248/476 |
| 5,937,073 | A | | 8/1999 | Van Gieson | 381/391 |
| 6,061,874 | A | * | 5/2000 | Tatara | 16/285 |
| 6,449,919 | B1 | * | 9/2002 | Behlen | 52/699 |

OTHER PUBLICATIONS

Product Description Document for NCB6 NCB0 NCBTL5 NCBTL8—New Construction Brackets for Boston Acoustics Designer Series Flush Mount Speakers, embedded in website on http://www.bostonacoustics.com/BostonOnlineStore.asp?ID×10; © 2001 Boston Acoustics, Inc.; Nov. 1, 2001.

Speco "Dream Series" Architectural In Wall & In Ceiling Speaker System, http://www.starkelectronic.com/spdream.htm; Nov. 1, 2001.

MTX, PCK5 Preconstruction Bracket for Model 520W and 502W (Pair), htp://www.audio–direct.com/cgl–bin/pgen_asp/papegen.asp?itemnum×PCK5; Nov. 1, 2001.

Hide a 1,000–Watt Powered Subwoofer in Your Ceiling, http:www.smarthome.com/97250601.html; Nov. 1, 2001.

Ceiling Mount Speaker Group—Designed for Flush Mounting in Ceilings, Technical Data Sheet, Nile Audio Corporation, © 2000 Niles Audio Corporation.

* cited by examiner

*Primary Examiner*—Leslie A. Braun
*Assistant Examiner*—Jon Szumny
(74) *Attorney, Agent, or Firm*—Knobbe Martens Olson & Bear LLP

(57) ABSTRACT

A folding speaker bracket comprising a first half and a second half, wherein the first half is rotably connected to the second half, so as to define an axis about which the first and second halves may rotate. By this rotable attachment of the two halves, the speaker may be folded and then inserted through a hole in a mounting surface that is smaller than it would have been if the bracket did not fold.

9 Claims, 6 Drawing Sheets

FOLDING SPEAKER BRACKET

BACKGROUND OF THE INVENTION

1. Field of the Invention

The invention relates to the field of audio system speaker mounting brackets.

2. Description of the Related Art

The popularity of ceiling and wall-mounted speakers in various types of building has steadily grown over the past decade. A variety of methods and devices for mounting speakers in these locations have therefore been developed. Several types of straps and brackets have been designed that are mounted to the framing of the wall or ceiling behind the outer surface of the wall to which the speaker is then affixed to secure it in place. Brackets have been designed that are placed behind the mounting surface that the speakers are then affixed to. One of the problems with these brackets is that they often need to be assembled behind the mounting surface, which can be difficult and time consuming.

Other bracket designs that are used with acoustic or suspended ceilings require that the suspended ceiling tile be removed for the installation of the bracket, and then replaced. This is necessary because the hole required for the bracket is larger than that required by the speaker.

SUMMARY OF THE INVENTION

The systems and methods have several features, no single one of which is solely responsible for its desirable attributes. Without limiting the scope as expressed by the claims that follow, its more prominent features will now be discussed briefly. After considering this discussion, and particularly after reading the section entitled "Detailed Description of the Preferred Embodiments" one will understand how the features of the system and methods provide several advantages over traditional systems and methods.

One aspect is a method of mounting a speaker in a ceiling, by cutting a mounting hole in the ceiling, folding a bracket, inserting the folded bracket through the mounting hole, unfolding the bracket, and mounting the speaker to the unfolded bracket. Another aspect is for a folding ceiling mount speaker bracket, which is hinged along approximately a midpoint of said bracket.

Yet another aspect is a speaker bracket, having a speaker-mounting portion with a first half, a second half and a hinge connecting said first half to said second half. This aspect also has a first bracket support attached to the first half of the speaker mounting portion, and a second bracket support attached to the second half of the speaker mounting portion. For these aspects a spring can be included to bias the rotation of the first half of the bracket portion. In some aspects the spring can be configured to bias the rotation of the first half of the bracket portion towards a fully unfolded position.

DETAILED DESCRIPTION OF THE PREFERRED EMBODIMENT

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
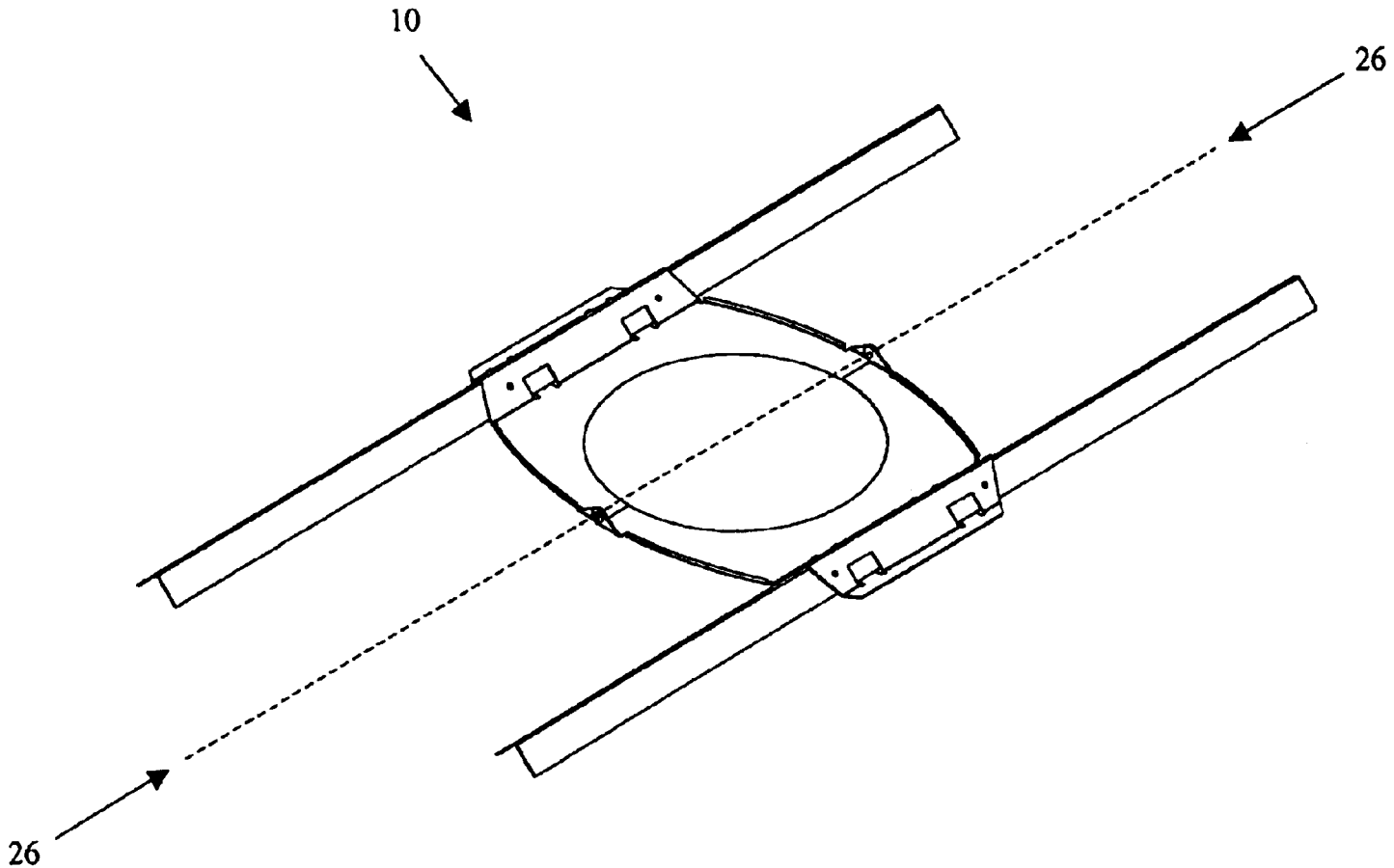
FIG. 1 is an isometric view of one embodiment of a speaker-mounting bracket in an unfolded state.

FIG. 1 is an isometric view of one embodiment of a speaker mounting bracket 10 in an unfolded state. As ceiling mounted speakers become more popular in construction of homes and offices it is increasingly important to find a fast and easy way to install such speakers at a relatively low cost. The embodiment illustrated in FIG. 1 comprises two supports, one on either side, and a central mounting portion in the middle that the speaker connects to. An axis of rotation 26 is formed by the use of pin joints to attach the two sides of the bracket to one another, which will be described more thoroughly later. Alternatively, a flexible material may be used on all or a portion of the bracket, thereby replacing the pin joints for providing a folding mechanism. By the use of a flexible material, the bracket may be folded and unfolded by bending the flexible material. Any material can be used for the flexible material that is capable of elastically or plastically deforming. These can include plastics and other polymers as well as any flexible metal, or any other flexible material known in the art. This simple design provides an inexpensive way to install speakers in ceilings and in other surfaces, such as walls, quickly and without more destruction of the wall than is necessary to fit the speaker into it.

Figure 2:
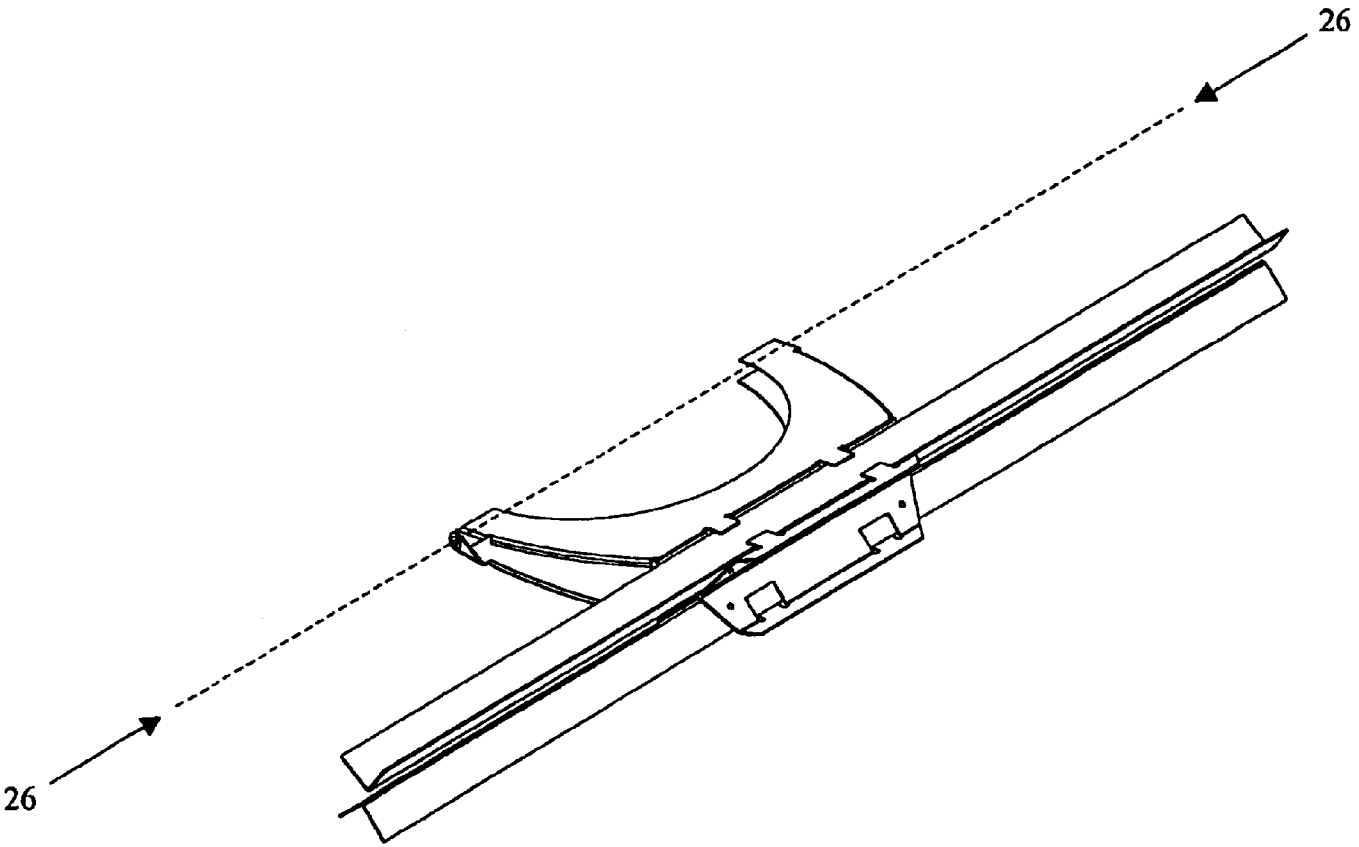
FIG. 2 is an isometric view of one embodiment of a speaker-mounting bracket in a folded state.

FIG. 2 is an isometric of one embodiment of a speaker mounting bracket in a folded state. The embodiment of the speaker bracket illustrated in this figure has been folded from the state in FIG. 1 to the state in FIG. 2. The bracket folds at its axis of rotation 26, described previously, by the use of pin joints to attach its two sides. Again, the use of a flexible material on all or a portion of the bracket may alternatively define the axis about which the bracket is folded. By folding the speaker bracket, the width of the bracket has been reduced, thereby allowing it to be inserted into a hole through the mounting surface that is smaller than the hole would have to be if the bracket was not folded.

Figure 3:
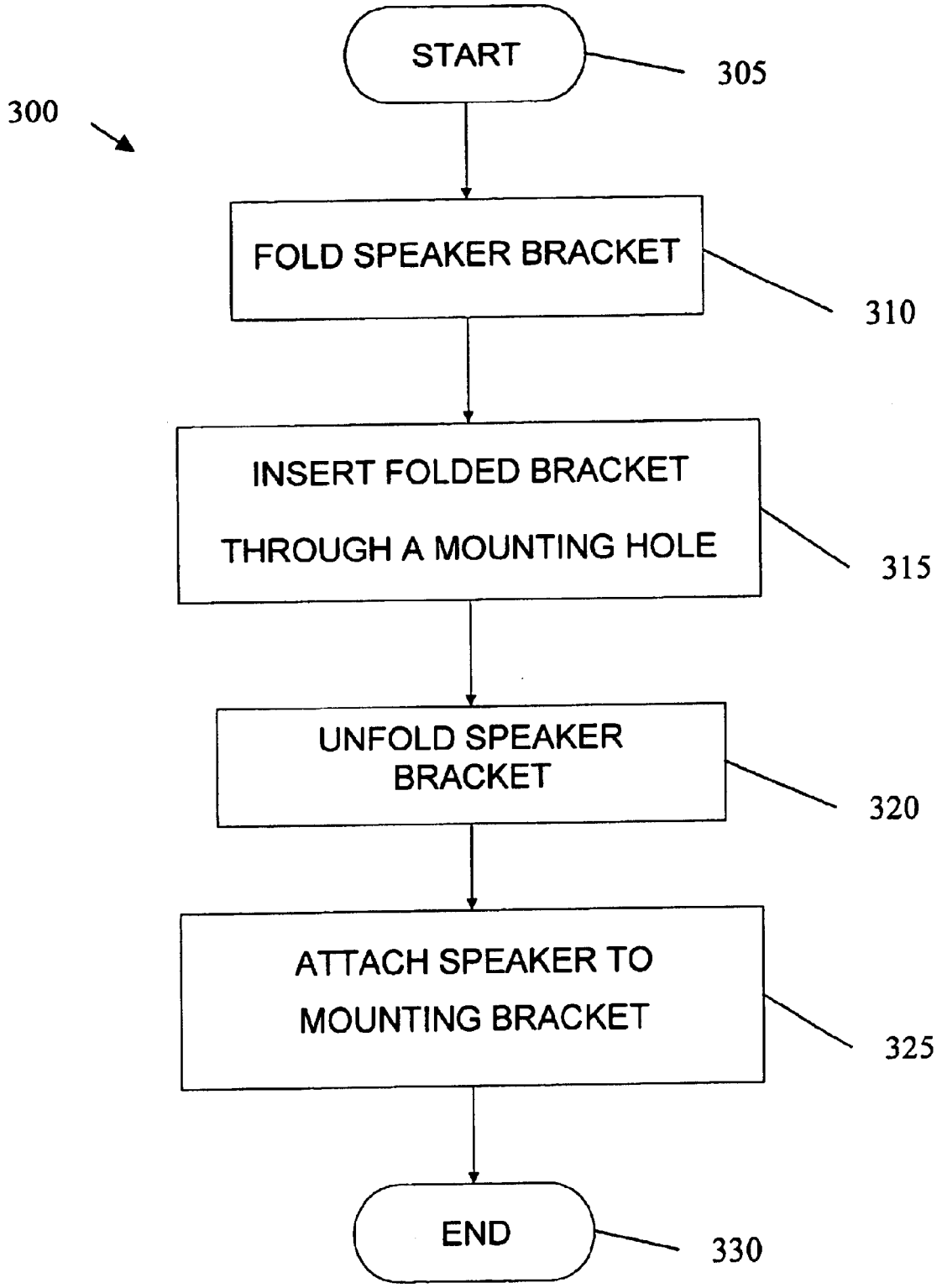
FIG. 3 is a flow chart illustrating an example set of steps in a process that can be used to mount a speaker to a mounting surface.

FIG. 3 is a flow chart illustrating an example set of steps in a process 300 that can be used to mount a speaker to a mounting surface. This example process 300 illustrated in FIG. 3 assumes that a hole already exists in a mounting surface and if one does not, a step to create such a hole can simply be added at the beginning of the process 300. The process 300 begins at process state 305 where it is assumed that the installer has prepared a hole and has the mounting bracket, speaker and related accessories and tools necessary to install the speaker. In the second step 310 of the process 300, the installer folds the bracket thereby reducing its width making it small enough to pass through the hole created in the mounting surface. The process then moves on to the third step 315.

In the third step 315 of the process 300, the installer inserts the bracket through the hole ensuring to keep it folded as it is inserted all the way through. Once the bracket is inserted through the hole, the installer can position the speaker mounting bracket correctly for the fourth step 320 of the process 300. At step four 315, the installer unfolds the bracket to expand it to its full width. After it has expanded, the bracket can no longer fit through the mounting hole thereby creating a rigid support to which the speaker can be mounted. In embodiments that include a spring, which will be discussed later, this step is made easier as the spring(s) are attached to the bracket in a manner that tends to expand the bracket to its full width. In these embodiments, all the installer has to do is squeeze the bracket to fold it and release the pressure on it to allow it to unfold. In the fifth step 325, the installer connects the speaker to the speaker wire if such wire is available, positions the speaker in the hole and against the speaker mounting bracket, and attaches the speaker to the bracket utilizing fasteners or other means known in the art. The process then ends at the final step 330, where the installer verifies that the speaker is installed securely and, if applicable, ensures the speaker operates properly. Through this process 300, an installation of a speaker in a mounting surface is simplified and made faster by the use of this folding speaker mounting bracket.

Figure 4:
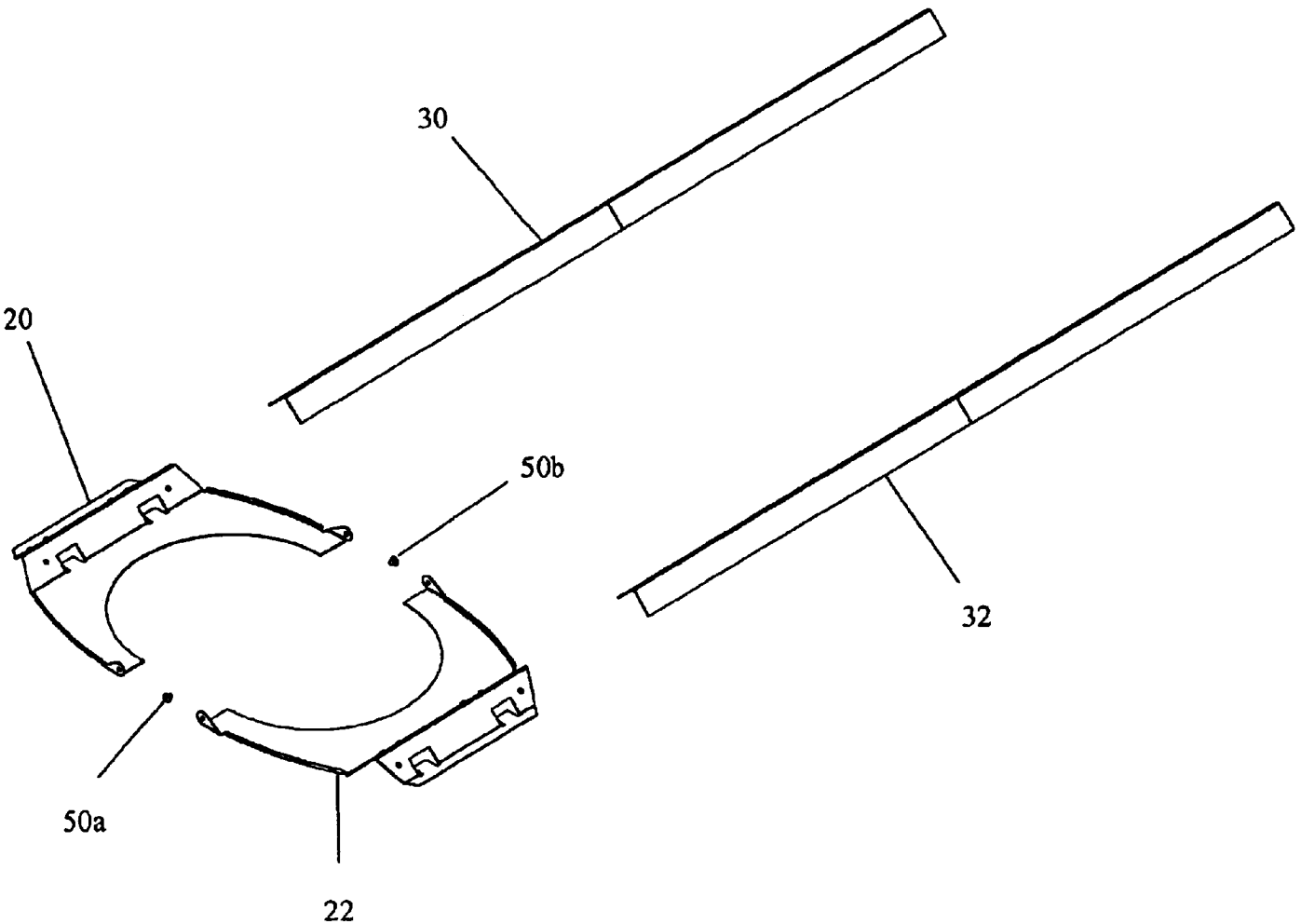
FIG. 4 is an exploded view of one embodiment of a speaker-mounting bracket.
Figure 5:
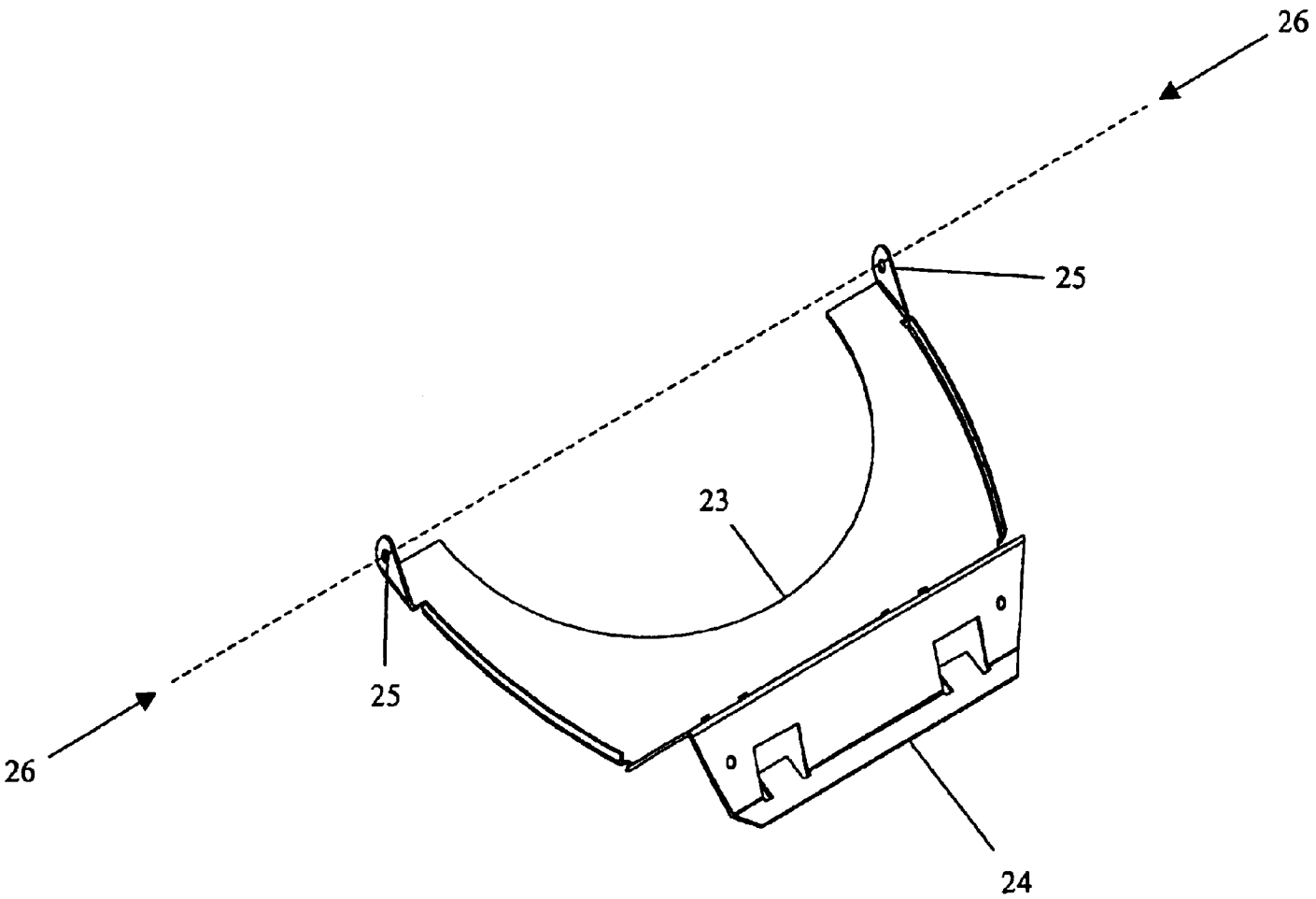
FIG. 5 is an isometric view of a bracket half of one embodiment.

FIG. 4 is an exploded view of the speaker-mounting bracket of FIGS. 1–3. FIG. 4 illustrates the various components that may make up certain embodiments of the bracket. In this example, the bracket is made up of 6 parts: first and second bracket halves 20, 22, first and second bracket supports 30, 32, and two fasteners 50*a*, 50*b*. Referring also to FIG. 5, an isometric view of an embodiment of a bracket half 20, 22, the first bracket half 20 and the second bracket half 22 each may be generally flat, but can be described as having two sides, an inside 23 and an outside 24. The outside 24 is where the two halves 20, 22 attach to a bracket support 30, 32, and the inside 23 is where they attach to each other. The inside 23 may have a pin joint 25 on each end to attach one bracket half 20 to the other bracket half 22. The pin joints 25 may utilize the fasteners 50*a*, 50*b* to attach the two bracket halves 20, 22, and they form an axis of rotation 26, whereby the first half 20 may rotate about the second half 22, or vice versa. Alternatively, the pin joints 25 may be formed on each bracket half 20, 22 in a manner that allows them to connect to one another without fasteners as well. In embodiments utilizing a flexible material in lieu of the pin joints 25, the bracket halves 20, 22 can be one unit having flexible material at least along the axis about which the bracket will be folded. In these embodiments, the pin joints 25 and the fasteners 50*a*, 50*b* are not needed and can be eliminated. The inside 23 of each bracket half 20, 22 is advantageously formed to mount a speaker.

In the example illustrated in FIG. 4, the insides 23 of the bracket halves 20, 22 are semi-circular so that they may be utilized to mount a round speaker. Other speaker shapes may be utilized as well, however, such as oval, rectangular, square, etc., and the insides 23 of the speaker bracket halves 20,22 would be the appropriate shape to accommodate insertion of the speaker's magnet, voice coil, diaphragm and any other components, so as to properly mount the speaker.

FIG. 4 also illustrates the use of bracket supports 30, 32 to support the bracket halves 20, 22 as the speaker is mounted. The bracket supports 30, 32 may be any shape capable of attaching to the outside 24 of the speaker bracket halves 20, 22. In the example illustrated by FIG. 4, the bracket supports 30, 32 are elongated rods having a generally V-shaped cross section. The supports 30, 32 are inserted through complementary shaped holes running through the outside 24 of each bracket half 20, 22 and thereby engage the bracket halves 20, 22. This is a simple means of engaging the bracket half 20, 22 with the bracket support 30, 32 but many other ways can be used. For instance, each support 30, 32 can be fastened to a bracket half 20, 22 with screws or bolts, or it can be welded to the bracket half 20, 22. Alternatively, the bracket halves 20, 22 may be manufactured in such a manner as to integrally incorporate the bracket supports 30, 32. The bracket supports 30, 32 serve to distribute the weight of the speaker over a wider area of the ceiling or other mounting surface, thereby reducing the material strength of the mounting surface required to support a particular speaker. As was mentioned earlier, the bracket supports 30, 32 can be of different shape than that illustrated in FIG. 4, such as being wider or longer so to distribute the weight of the speaker differently.

Although not illustrated in FIG. 4, a spring may be utilized at the joints between the two speaker halves 20, 22 to bias the bracket 10. The spring may bias the bracket towards the folded or unfolded position. In embodiments wherein the spring biases the bracket towards the open position, the bracket may be folded, inserted through a hole cut into a mounting surface and then released, automatically unfolding under the force of the spring. The speaker may then be attached to the bracket to complete a relatively simple installation.

Figure 6:
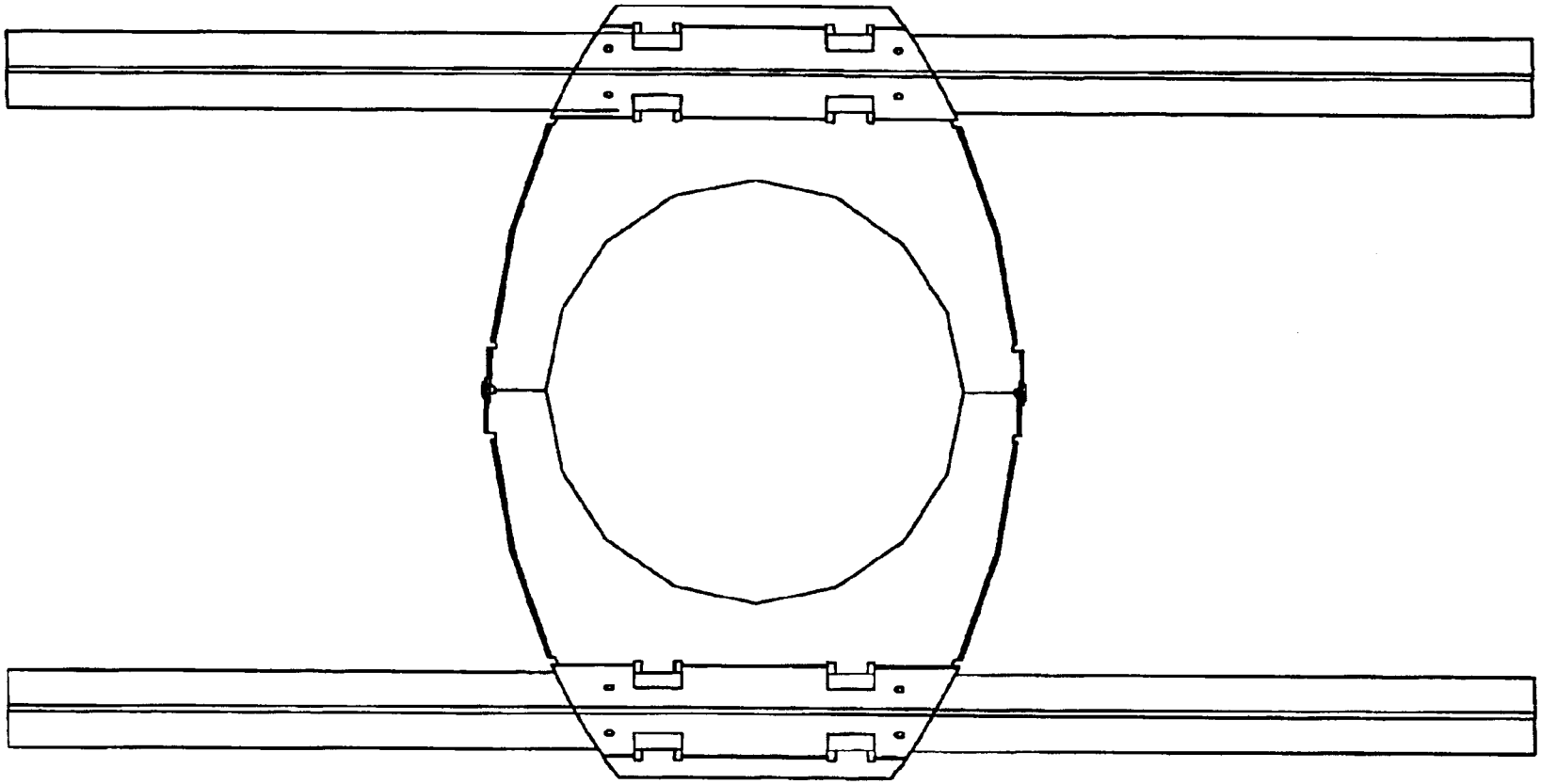
FIG. 6 is a top view of one embodiment of a speaker-mounting bracket in an unfolded state.

FIG. 6 is a top view of one embodiment of a speaker-mounting bracket in an unfolded state. As can be seen by the illustration, the speaker bracket in FIG. 4 is able to distribute the weight of the speaker over a wide area of the mounting surface. As mentioned previously, any shape can be used for the bracket halves or the bracket supports (both identified previously with respect to FIG. 2), and thereby alter the type of speaker able to be mounted and the manner in which the weight of the speaker is distributed as it is mounted.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A speaker bracket, comprising:

a first half including a first speaker mount half and a first support attached to the first speaker mount half along a first axis, wherein the first support extends substantially beyond an outer perimeter of the first speaker mount half; and a second half including a second speaker mount half and a second support attached to the second speaker mount half along a second axis different from the first axis, wherein the second support extends substantially beyond an outer perimeter of the second speaker mount half;

wherein the first half is rotatably connected to the second half, so as to define a third axis about which the first half and second half may rotate with respect to one another, wherein the first and second axes are offset from the third axis, wherein the first and second speaker mount halves define an opening adapted to receive at least a portion of a speaker, and wherein the first and second supports are configured to contact only a backside of a mounting surface such that the entire bracket is maintained behind the backside of a mounting surface.

2. The speaker bracket of claim 1, wherein the first half is adapted to rotate to and from an unfolded position.

3. The speaker bracket of claim 2, further comprising a spring to bias the rotation of the first and second halves.

4. The speaker bracket of claim 3, wherein the spring is configured to bias the rotation of the first and second halves towards the unfolded position.

5. The speaker bracket of claim 1, wherein the first and second supports have a generally V-shaped cross section.

6. A speaker bracket for mounting a speaker to a wall having a hole that is smaller than the speaker, comprising:

a speaker mounting portion with an opening adapted to receive at least a portion of a speaker and having a first half, a second half and a hinge connecting the first half to the second half along a first axis;

a first bracket support attached to the first half of the speaker mounting portion along a second axis different from the first axis, wherein the first bracket support extends substantially beyond an outer perimeter of the first half, and a second bracket support attached to the second half of the speaker mounting portion along a third axis different from the first and second axes, wherein the second bracket support extends substantially beyond an outer perimeter of the second half;

wherein the first and second supports are configured to contact only a backside of a mounting surface such that the entire bracket is maintained behind backside of the mounting surface along a single plane.

7. The speaker bracket of claim 6, further comprising a spring to bias a relative rotation of the mounting portion halves.

8. The speaker bracket of claim 7, wherein the spring is configured to bias the rotation of the first half of the bracket portion towards an unfolded position.

9. The speaker bracket of claim 6, wherein the first and second bracket supports have a generally V-shaped cross section.

* * * * *